US006004220A

United States Patent [19]

Razzano

[11] Patent Number: 6,004,220

[45] Date of Patent: Dec. 21, 1999

[54] PUTTING TRAINING DEVICE

[76] Inventor: Eugene Razzano, 12155 Dickenson La., Orlando, Fla. 32801

[21] Appl. No.: 08/970,840

[22] Filed: Nov. 14, 1997

[51] Int. Cl.[6] ..... A63B 69/36

[52] U.S. Cl. ..... 473/200; 473/280; 273/DIG. 20

[58] Field of Search ..... 473/200, 280, 473/281; 273/199 R, DIG. 20

[56] References Cited

U.S. PATENT DOCUMENTS

| | | | |
|---|---|---|---|
| 3,069,170 | 12/1962 | Dillon | 473/280 |
| 3,796,435 | 3/1974 | Dale | 473/200 |
| 4,402,511 | 9/1983 | Simjian | 473/200 |
| 5,704,853 | 1/1998 | Maruko et al. | 473/383 X |
| 5,759,109 | 6/1998 | Martini | 473/200 |

FOREIGN PATENT DOCUMENTS

| | | | |
|---|---|---|---|
| 930255 | 7/1963 | Canada | 473/280 |

*Primary Examiner*—George J. Marlo

*Attorney, Agent, or Firm*—Allen, Dyer, Doppelt, Milbrath & Gilchrist, P.A.

[57] ABSTRACT

A putt training device is provided which preferably includes a body having substantially the shape of a cylinder and a moment of inertia about its longitudinal axis substantially in the range of 79.31 to 84.21 grams-centimeters squared. The body also has first and second substantially flat ends and a substantially continuous outer surface extending between the first and second ends. The body is adapted to be positioned so that substantially the entire continuous length of the body abuttingly contacts a putting surface during rolling movement of the body on a putting surface to thereby provide a visual indication of which position the face of a golf putting club strikes after contact with the body.

5 Claims, 4 Drawing Sheets

PUTTING TRAINING DEVICE

FIELD OF THE INVENTION

The present invention relates to the golf industry and, more particularly, to the field of golf putt training devices and methods.

BACKGROUND OF THE INVENTION

Over the years, various golf putt training systems have been developed for training golfers for effective putting techniques. These golf putt training systems often use extensive electronics, laser or other optical devices, or custom-designed putt training grids or courses. These golf putt training systems, however, are often complex, bulky, and quite expensive.

Other more simple golf putt training devices have also been developed for training golfers for effective putting techniques. Many of these prior devices, however, require or include a golf ball or golf-ball-shaped member to be associated therewith or are merely sport novelty items. Some examples can be seen in U.S. Pat. No. 2,884,254 by Miner titled "*Practice Golf Ball*," U.S. Pat. No. 4,664,387 by Tardiff titled "*Practice Putting Ball*," U.S. Pat. No. Des. 259,111 by Kinney titled "*Sport Novelty Device*," U.S. Pat. No. Des. 202,711 by Philpitt titled "*Novelty Item Or The Like For Golfers*," and U.S. Pat. No. Des. 220,769 by LaHue titled "*Slidable Golf Ball For Putting Practice*." These devices, however, can be awkward to use, can have weight and stability problems when stroking the device, can be less effective for indicating to a golfer problems with a putting stroke, and provide little simulation of directly striking a golf ball along a putting surface.

Still other putt training devices have been developed which provide a wheel-type or a rim-type configuration which, in effect, carry a golf ball along a putting surface. Examples of these devices can be seen in U.S. Pat. No. 4,494,757 by Simjian titled "*Golf Putting Device*," U.S. Pat. No. 4,402,511 by Simjian titled "*Golf Putting Training Device*," U.S. Pat. No. 4,278,254 by Simjian titled "*Golf Putting Device*," U.S. Pat. No. Des. 273,031 by Simjian titled "*Golf Putting Aid*." These putt training devices can be awkward to use and to manufacture and provide little direct simulation to putting only a golf ball along a putting surface.

Also, some putt training devices have been developed which are essentially formed from a pair of spaced-apart golf balls and an elongate rod extending between and having ends thereof respectively connected to one of the pair of golf balls. Examples of these type of devices can be seen in U.S. Pat. No. 3,918,720 by Gordos titled "*Putting Trainer*," U.S. Pat. No. 5,595,546 by Masters titled "*Golf Putting Aid*," and U.S. Pat. No. 4,411,431 by Judice titled "*Golf Putting Practice Device*." These devices likewise can be awkward to use and to manufacture and provide little direct simulation to putting only a golf ball along a putting surface.

Further still, a golf putting practice device has been developed which has a wheel-shape configuration with a rounded peripheral surface that simulates the rounded outer surface of a golf ball. An example of this device can be seen in U.S. Pat. No. 3,796,435 by Dale titled "*Golf Putting Practice Device*." This device has a dimpled peripheral surface and has a diameter and weight corresponding to that of a United States Golf Association approved golf ball. Nevertheless, because the peripheral surface of the device is rounded, e.g., almost as if the ends of a golf ball were cut off or disconnected, the device is less effective in indicating to a golfer proper contact of the head of a golf putting club, i.e., a putter, with the outer surface of a standard golf ball and training proper putting skills.

SUMMARY OF THE INVENTION

With the foregoing in mind, the present invention advantageously provides a relatively simple golf putt training device and methods for training putting skills which includes direct simulation to putting only a golf ball. The present invention also advantageously allows a golfer to more effectively develop by training proper putt stroking skills such as during a pendulum-type putting swing. The present invention additionally advantageously provides a golf putt training device which has about the same moment of inertia as a standard golf ball. The present invention further provides visual feedback to a golfer on a proper putting stroke.

More particularly, a putt training device according to an embodiment of the present invention preferably includes a cylindrical body having about the same moment of inertia as a standard golf ball, first and second substantially flat ends, and a substantially uniform outer surface extending between the first and second ends. The cylindrical body is preferably adapted to be positioned so that substantially the entire length of the cylindrical body abuttingly contacts a putting surface during rolling movement of the cylindrical body on a putting surface to thereby provide a visual indication of which position the face of a golf putting club strikes after contact with the cylindrical body. The visual indication preferably is at least one of three positions of the golf club putting face, namely a square face, an open face, or a closed face.

According to other aspects of the present invention, the cylindrical body of the golf putt training device may also further include a core material, a cover surrounding the core material, and a plurality of dimples formed in the cover material. The cylindrical body also preferably has about the same elasticity, the same volume, and the same mass as a standard golf ball. The cylindrical body additionally preferably has a length greater than the radius of a standard golf ball. Further still, each of the substantially flat first and second ends of the cylindrical body preferably defines a circle and an imaginary line extending between the respective center points of the circles defines an axis of rotation of the cylindrical body. The axis of rotation and the lengthwise extent of the substantially uniform outer surface of the cylindrical body being substantially parallel.

The present invention also preferably includes methods of training golf putting skills. A first method of training putting skills preferably includes providing a cylindrical body having a substantially uniform outer surface and flushly contacting substantially the entire length of the cylindrical body with a squared and relatively flat face of a golf putting club.

A second method of training golf putting skills according to the present invention preferably includes providing a cylindrical body having a substantially uniform outer surface and abuttingly contacting only a proximal portion of the length of the cylindrical body with an opened and relatively flat face of a golf putting club.

Still a third method of training putting skills preferably includes providing a cylindrical body having a substantially uniform outer surface and abuttingly contacting only a distal portion of the length of the cylindrical body with a closed and relatively flat face of a golf putting club.

Yet a fourth method of training putting skills according to the present invention preferably includes providing a device having substantially the same moment of inertia as a standard golf ball. The device, however, for distinguishing purposes should be recognized as not being a golf ball. The method also preferably includes putting the device by contact with a face of a golf putting club to thereby provide visual indication of whether a proper putting stroke was performed on the device. The visual indication is preferably one of at least three positions of contact of the face of the golf putting club with the device, namely the at least three positions being a squared face, an opened face, or a closed face. Additional visual indications advantageously can also include color variations, for example, formed adjacent respective end portions of the cylindrical body so that variations from a proper putting stroke can even more easily be observed.

Therefore, a golf putt training device and methods of training putting skills advantageously allows a compact and relatively inexpensive golf putt training device to be readily carried in pocket or the hand of a golfer. This enables a golfer to quickly practice putting strokes prior to a round of golf, a tournament, or even prior to an actual putting shot in a leisure game of golf. By quickly learning or memorizing the visual indications representing the three positions of the golf club putting face when striking a ball, namely a square face, an open face, or a closed face, the golf putt training device provides immediate feedback to the golfer on a proper way to address and stroke the ball with the face of a golf putting club.

BRIEF DESCRIPTION OF THE DRAWINGS

Some of the objects and advantages of the present invention having been stated, others will become apparent as the description proceeds when taken in conjunction with the accompanying drawings in which.

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and/or double prime notation are used to indicate similar elements in alternative embodiments.

Figures 1, 2, 3:
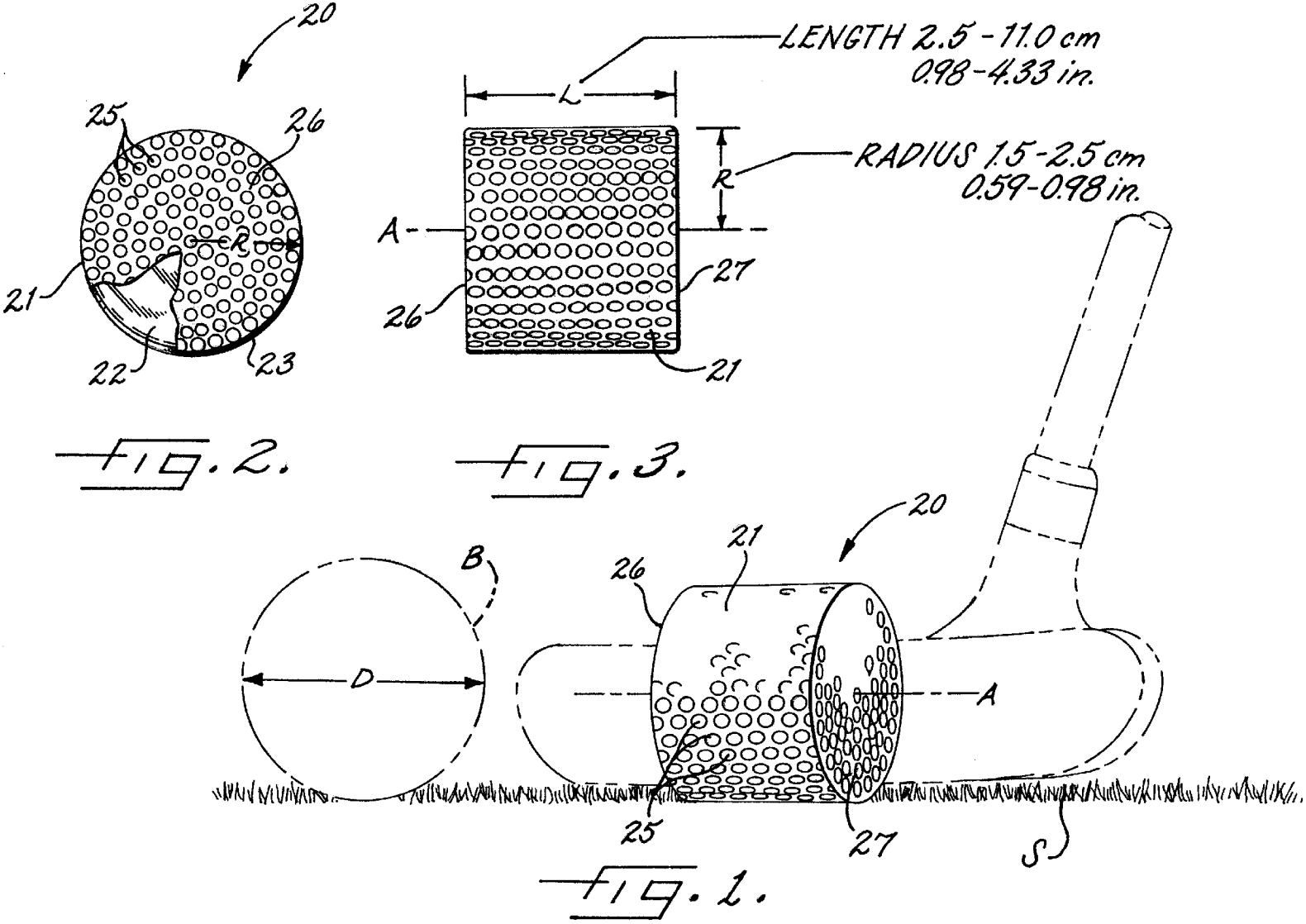
FIG. 1 is a side perspective view of a golf putt training device and a distal portion of a golf putting club and golf ball shown in phantom view according to an embodiment of the present invention.
FIG. 2 is a side elevational view of a golf putt training device according to an embodiment of the present invention.
FIG. 3 is a top plan view of a golf putt training device according to an embodiment of the present invention.
Figure 5:
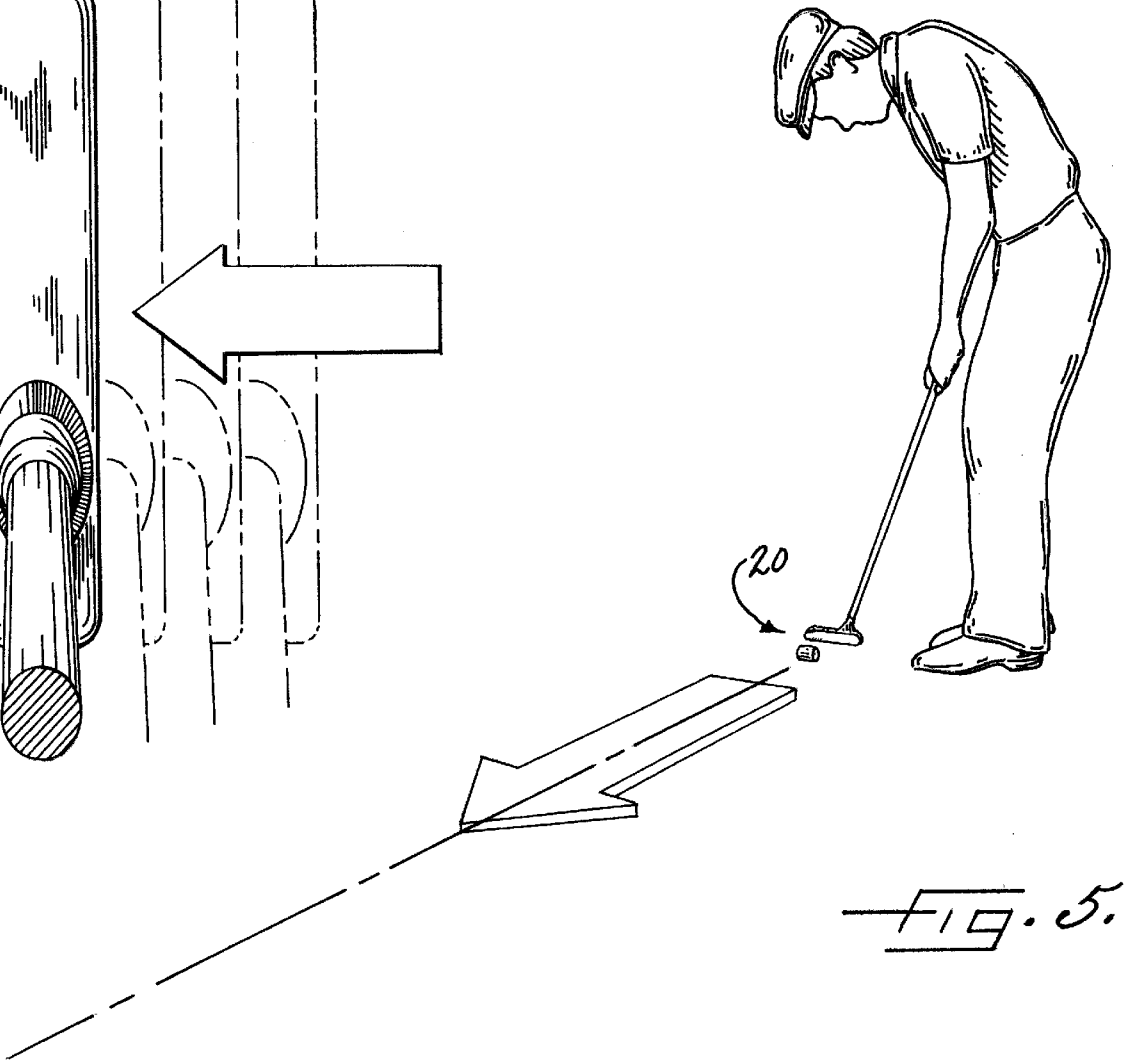
FIG. 5 is a perspective view of a golfer squarely addressing and flushly contacting the outer surface of a golf putt training device according to an embodiment of the present invention.
Figure 4:
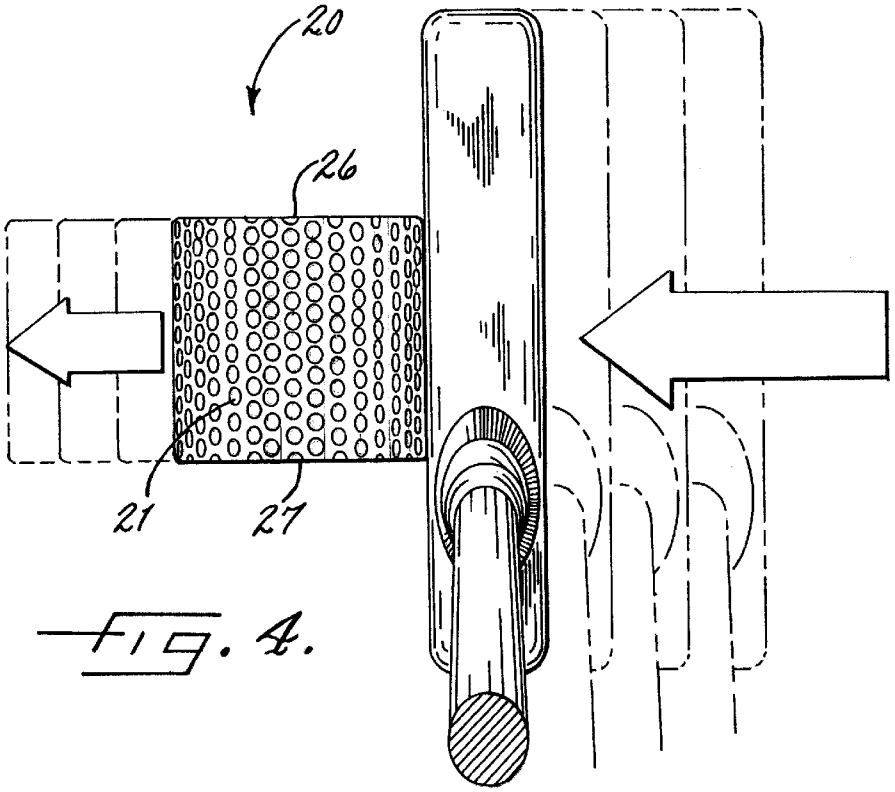
FIG. 4 is a top perspective view of a squared face of a golf putting club squarely addressing and flushly contacting the outer surface of a golf putt training device according to an embodiment of the present invention.

FIGS. 1–3 illustrate a putt training device according to the present invention. The putt training device 20 preferably has a cylindrical body 21 such as illustrated. The cylindrical body 21 preferably includes a core material 22, a cover 23 surrounding the core material 22, and a plurality of golf ball dimples 25 formed in the cover 23. The dimples 25 can either be positioned along the entire outer surface of the device 20 or can be omitted from the ends 26, 27 thereof. As understood by those skilled in the art, the core material is preferably formed of a low density polyethylene material, and the cover is preferably formed of Surlyn material. It will also be understood by those skilled in the art that the entire device 20 advantageously also can be formed of the same material, e.g., Surlyn, for ease of manufacturing, for reducing the cost of manufacturing, and for making construction generally easier. Because the cover 23 substantially surrounds the entire core material, in essence, the outer surface of the device 20 is the outer surface of the cover. Also, as an alternate minor variation within the scope of the present invention and as understood by those skilled in the art, the entire cylindrical body 21 can be formed of Surlyn material so that the cylindrical body 21 is essentially entirely made of Surlyn material.

As perhaps best illustrated in FIG. 1, the cylindrical body 21 of the golf putt training device 20 preferably has a length L longer than the radius r, or about one-half (½) of the diameter D, of a standard golf ball B. The term length L as used herein refers to the height of the cylindrical body 21, but for ease of description and because the cylindrical body is turned or positioned for rolling the term length is used herein. The cylindrical body 21 preferably has a radius R in the range of about 1.5 to 2.5 centimeters and a length L in the range of about 2.5 to about 11.0 centimeters. The length L, for example, can vary somewhat based upon corresponding changes in density and volume. The radius R and mass, however, are preferably maintained at about the same values.

The cylindrical body 21 of the device 20 is adapted to be positioned so that substantially the entire length L of the cylindrical body 21 abuttingly contacts a putting surface S during rolling movement of the cylindrical body 21 on a putting surface S to thereby provide a visual indication which position the face of a golf putting club strikes after contact with the cylindrical body 21. As perhaps best shown in FIGS. 4–9, the visual indication preferably is at least one of three positions of the golf club putting face, namely a square face, an open face, or a closed face. Additional visual indication advantageously can also include color markers, patterns, or other indicators (see, e.g., FIG. 8) formed on the outer surface of the cylindrical body 21 so that during rolling movement of the body, the colors, patterns, or other indicators further enhance the golfers ability to detect changes or variations between a proper putting stroke and rolling path and improper strokes and rolling paths.

Preferably, the cylindrical body 21 has about the same moment of inertia as a standard golf ball B so that putting of the cylindrical body substantially emulates the putting of a standard golf ball B. As understood by those skilled in the art, the term standard golf ball as used herein refers to United States Golf Association, a British Golf Association, or other country or golf association approved or sanctioned golf balls, other golf industry approved or sanctioned golf balls, or the specifications for these approved or sanctioned golf balls. The cylindrical body 21 also preferably has about the same elasticity, mass, and volume as a standard golf ball as well. The elasticity, for example, is preferably about the same at low levels of collision or force, i.e., compressibility, such as experienced with putting a standard golf ball.

In essence, the cylindrical body 21 preferably simulates a standard golf ball in construction and design, excepts for the cylindrical shape and size. Although prior art devices attempted to simulate a golf ball in diameter and weight, these prior art devices, however, failed to recognize that, more importantly, the moment of inertia of the shaped device, e.g., cylindrical body, and a standard golf ball B is what should be simulated.

Although it will be recognized that other various shapes of bodies can be used according to the present invention, the cylindrical body 21 has distinct advantages over other shapes especially where the other devices fail to recognize the importance of the moment of inertia for simulating the golf putting stroke. These advantages, for example, include the direct visualization, direct feedback, similar feel, similar vibration, and relationship between the proper putting stroke and the smooth rolling tendencies of a cylinder.

An example of this advantageous relationship between a standard golf ball B and a cylindrical shaped body of a golf putt training device 20 having substantially the same moment of inertia, as understood by those skilled in the art, according to the present invention is shown in the table of calculated values herein below and within a range of about ±3% for these values.

| | SPHERE (Golf Ball) | CYLINDER (Device 20) |
|---|---|---|
| Radius | 2.13 cm | 1.89 cm (1.5–2.5) |
| Mass | 45.93 g | 45.93 g |
| Length | -NA- | 3.53 cm (2.2–11) |
| Volume | 39.5 $cm^3$ | 39.5 $cm^3$ |
| Surface Area | 57.0l $cm^2$ | 47.49 $cm^2$ |
| Moment of Inertia | 81.76 $g \cdot cm^2$ | 81.76 $g \cdot cm^2$ |
| Density | 1.169 $cm^3$ | 1.169 $cm^3$ |

The volume equation, as understood by those skilled in the art, is as follows:

$$\text{Volume} = \frac{4}{3}\pi r^3 = \frac{4}{3}\P(2.13)^3 = 39.5\,\text{cm}^3.$$

The moment of inertia equation for a cylinder, as understood by those skilled in the art, is generally as follows:

$$\text{Moment of Inertia} = \frac{2}{5}(\text{Mass})(r^2) = \frac{2}{5}(45.93)(2.13)^2 = 81.755\ \text{g}\cdot\text{cm}^2.$$

The density equation, as understood by those skilled in the art, is as follows:

$$\text{Density} = \frac{\text{Mass}}{\text{Volume}} = \frac{45.93\ \text{g}}{39.5\ \text{cm}^3} = 1.16\ \text{g/cm}^3.$$

As perhaps best illustrated in FIG. 3, the cylindrical body 21 preferably has respective first and second substantially flat ends 26, 27 and a substantially uniform outer surface extending between the first and second ends 26, 27. The flat ends, for example, advantageously allow easier handling and stacking both in use, in shipping, and in manufacturing. The flat ends also advantageously allow calculations of moment of inertia and other values as described above to more easily be performed. It will be understood by those skilled in the art that the ends can also be rounded according to the present invention. If the ends are rounded or other configuration are used for the body shape, however, care has to be taken in ensuring that the moment of inertia and other values as described above are still about the same as a standard golf ball. The first and second ends 26, 27 as used and described herein also refer to the respective bases of the cylindrical body 21, but for ease of description and because the cylindrical body is turned or positioned for rolling the terms first and second ends are used herein.

Preferably, each of the substantially flat first and second ends 26, 27 defines a circle. As understood by those skilled in the art, the first and second ends 26, 27 lie in substantially parallel planes, and the outer surface of composed of line segments that connect corresponding points of the peripheral boundaries of the respective circles are substantially perpendicular to the planes of the first and second ends 26, 27.

Also, an imaginary line extending between the respective center points of the circles defines an axis of rotation A of the cylindrical body 21. The axis of rotation A and the lengthwise extent of the outer surface of the cylindrical body 21 are generally substantially parallel, e.g., particularly when viewed from a side elevational view as shown in FIG. 3. The outer surface of the cylindrical body 21 preferably abuttingly contacts an underlying surface, e.g., grass, artificial turf, indoor or outdoor carpeting, or other floor or ground surfaces. Accordingly, because of the shape of the body, frictional contact of the outer surface with the underlying surface may be a factor and should be considered in comparing a standard golf ball to the cylindrical body 21, such as in the sample calculations set forth above, but it is believed that this differences will be minimal. Such friction factor, for example, may also vary depending upon the surface area of the contacting outer surface or surfaces of the putting device 20 in comparison to the contacting outer surface of a standard golf ball with the various types of putting surfaces, e.g., grass, turf, carpet, concrete, etc., such as set forth above.

As illustrated in FIGS. 1–9, the present invention also preferably includes methods of training golf putting skills. As perhaps best shown in FIGS. 4–5, a first method of training putting skills preferably includes providing a cylindrical body 21 having a substantially uniform outer surface and flushly contacting substantially the entire length L of the cylindrical body 21 with a squared and relatively flat face of a golf putting club. The method can also include squaring the face of a golf putting club and performing a pendulum-type putting swing with the golf putting club prior to the flush contact of the face of the golf putting club with the cylindrical body 21.

Figures 6, 7:
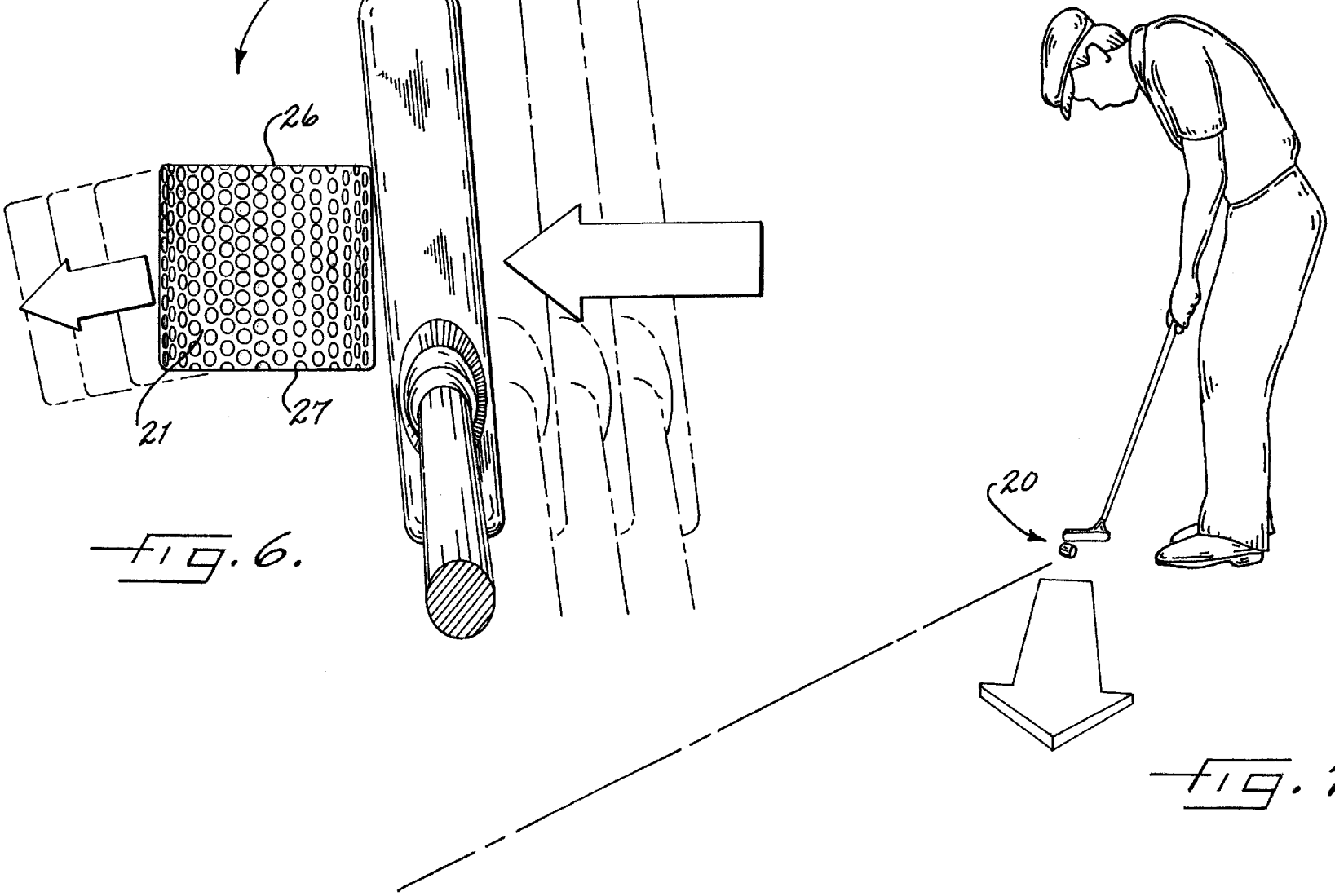
FIG. 6 is a top perspective view of a closed face of a golf putting club addressing and abuttingly contacting the outer surface of a golf putt training device according to an embodiment of the present invention.
FIG. 7 is a perspective view of a golfer addressing and abuttingly contacting the outer surface of a golf putt training device with a closed face of a golf putting club according to an embodiment of the present invention.

As perhaps best shown in FIGS. 6–7, a second method of training golf putting skills according to the present invention preferably includes providing a cylindrical body 21 having a substantially uniform outer surface and abuttingly contacting only a proximal portion of the length L of the cylindrical body 21 with an opened and relatively flat face of a golf putting club. The method can also include opening the face of a golf putting club during a putting swing with the golf putting club prior to the abutting contact of the face of the golf putting club with the cylindrical body 21.

Figures 8, 9:
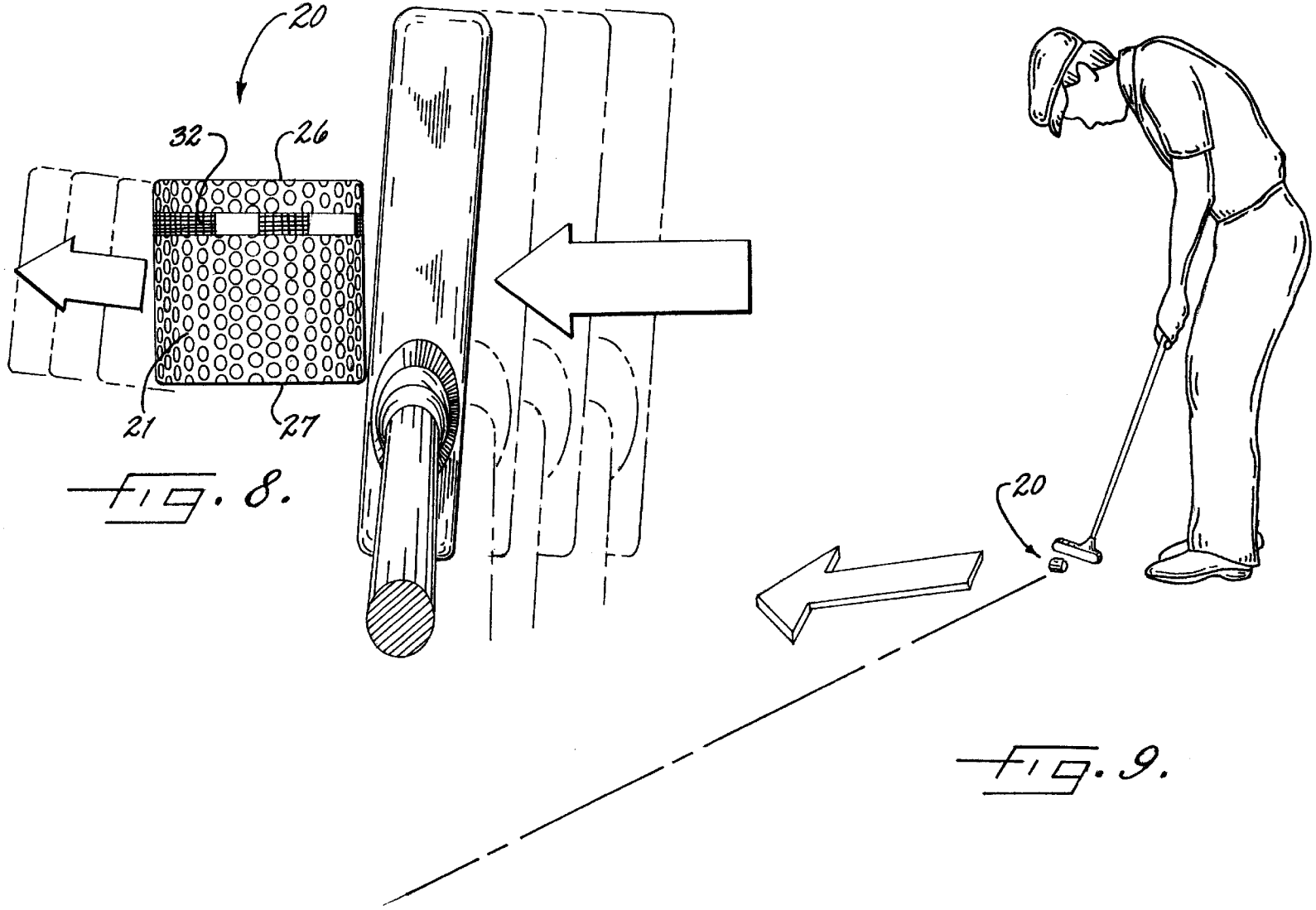
FIG. 8 is a top perspective view of a closed face of a golf putting club addressing and abuttingly contacting the outer surface of a golf putt training device according to an embodiment of the present invention.
FIG. 9 is a perspective view of a golfer addressing and abuttingly contacting the outer surface of a golf putt training device with a closed face of a golf putting club according to an embodiment of the present invention.

As perhaps best shown in FIGS. 8–9, still a third method of training putting skills preferably includes providing a cylindrical body 21 having a substantially uniform outer surface and abuttingly contacting only a distal portion of the length L of the cylindrical body 21 with a closed and relatively flat face of a golf putting club. The method can also include closing the face of a golf putting club during a putting swing with the golf putting club prior to the abutting contact of the face of the golf putting club with the cylindrical body 21.

Yet a fourth method of training putting skills preferably includes providing a device 20 having substantially the same moment of inertia as a standard golf ball B. The device 20, however, for distinguishing purposes should be recognized as not being a golf ball. The method also preferably includes putting the device 20 by contact with a face of a golf putting club to thereby provide visual indication of whether a proper putting stroke was performed on the device. The visual indication is preferably one of at least three positions of contact of the face of the golf putting club with the device, namely the at least three positions being a squared face, an opened face, or a closed face (see, e.g., FIGS. 4–9). Additional visual indications advantageously can also include color variations, patterns, markers, or other indicators 32 (see, e.g., FIG. 8). These additional visual indicators 32 or indications, for example, can be formed adjacent respective end portions of the cylindrical body so that variations from a proper putting stroke can even more easily be observed.

As illustrated and described herein, a golf putt training device 20 and methods of training putting skills advantageously allows a compact and relatively inexpensive golf putt training device 20 to be readily carried in pocket or the hand of a golfer. This enables a golfer to quickly practice putting strokes prior to a round of golf, a tournament, or even prior to an actual putting shot in a leisure game of golf. When a golfer or user quickly learns or memorizes the visual indications representing the three positions of the golf club putting face when striking a ball B, namely a square face, an open face, or a closed face, the golf putt training device 20 provides immediate feedback to the golfer on a proper way to address and stroke the ball B with the face of a golf putting club. In other words, the golf putt training device 20 advantageously assists the golfer in developing a more proper putting stroke whereby the trained golfer can then squarely address a golf ball B with the face of a golf putting club each and every time.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A putt training device comprising a body having substantially the shape of a cylinder and a moment of inertia about its longitudinal axis substantially in the range of 79.31 to 84.21 grams-centimeters squared, first and second substantially flat ends, and an outer surface extending between the first and second ends, the body being adapted to be positioned so that substantially the entire continuous length of the body abuttingly contacts a putting surface during rolling movement of the body on a putting surface to thereby provide a visual indication of which position the face of a golf putting club strikes after contact with the body.

2. A putt training device as defined in claim 1, wherein the body has a relatively uniform and continuous outer surface and includes plurality of golf ball dimples formed in a relatively uniform and continuous outer surface.

3. A putt training device as defined in claim 2, wherein each of the substantially flat first and second ends of the body having substantially the shape of a cylinder defines a circle and an imaginary line extending between the respective center points of the circles defines the longitudinal axis of rotation of the body, the longitudinal axis of rotation and the lengthwise extent of the relatively continuous outer surface of the cylindrical body being substantially parallel, and wherein an outer surface of the body includes at least one visual indicator for providing feedback on a putting stroke.

4. A putt training device as defined in claim 1, wherein the body has a relatively uniform outer surface and includes a plurality of golf ball dimples formed in the relatively uniform outer surface.

5. A putt training device as defined in claim 4, wherein the body includes a core material and a cover surrounding the core material, the cover having the plurality of golf ball dimples formed therein.

* * * * *